US010867726B2

(12) United States Patent
Tillotson, Jr.

(10) Patent No.: US 10,867,726 B2
(45) Date of Patent: Dec. 15, 2020

(54) WIRE INVENTORY INDEXING SYSTEM

(71) Applicant: John D Tillotson, Jr., Scottsdale, AZ (US)

(72) Inventor: John D Tillotson, Jr., Scottsdale, AZ (US)

( * ) Notice: Subject to any disclaimer, the term of this patent is extended or adjusted under 35 U.S.C. 154(b) by 0 days.

(21) Appl. No.: 16/774,990

(22) Filed: Jan. 28, 2020

(65) Prior Publication Data

US 2020/0161026 A1 May 21, 2020

Related U.S. Application Data

(63) Continuation-in-part of application No. 16/516,672, filed on Jul. 19, 2019, now Pat. No. 10,547,125, which is a continuation-in-part of application No. 16/133,466, filed on Sep. 17, 2018, now Pat. No. 10,374,400, and a continuation-in-part of application No. 16/022,496, filed on Jun. 28, 2018, now abandoned, said application No. 16/133,466 is a continuation-in-part of application No. 16/022,496, filed on Jun. 28, 2018, now abandoned.

(60) Provisional application No. 62/559,934, filed on Sep. 18, 2017, provisional application No. 62/532,352, filed on Jul. 13, 2017.

(51) Int. Cl.

| | |
|---|---|
| ***H01R 43/28*** | (2006.01) |
| ***H01R 43/052*** | (2006.01) |
| ***H01B 13/012*** | (2006.01) |
| ***B65H 57/00*** | (2006.01) |
| ***H01B 13/00*** | (2006.01) |

(52) U.S. Cl.

CPC ..... *H01B 13/01236* (2013.01); *B65H 57/00* (2013.01); *H01B 13/0003* (2013.01); *H01B 13/01209* (2013.01); *H01R 43/052* (2013.01); *H01R 43/28* (2013.01)

(58) Field of Classification Search

CPC ..... H01B 13/01236; H01B 13/01209; H01B 13/0003; H01R 43/28; B65H 57/00; B65H 57/16; B65H 51/18; B65H 2701/36

See application file for complete search history.

(56) References Cited

U.S. PATENT DOCUMENTS 4,164,808 A * 8/1979 Gudmestad ..... H01R 43/052 29/564.4
4,653,159 A * 3/1987 Henderson ..... H01B 13/01245 140/93 R
4,729,152 A * 3/1988 Hammond ..... H01R 43/01 29/33 M (Continued)

*Primary Examiner* — Michael C Zarroli

(57) ABSTRACT

A computerized discrete wire inventory indexing system organizes and automates the intake of wiring used in a wire harness assembly work cell. Functions in a work cell may be duplicated into a second arrangement symmetrically opposite to a first arrangement so that an indexing system in accordance with the invention may operate between or alongside the adjacent work cells to execute its tasks in tandem and produce pairs of wires to be used within the two work cells. The wire indexing system operates with a tandem wire pulling machine on a movable shuttle that grabs pairs of wires from the indexing system and draws them to length. Both the shuttle and the wire indexing system may includes fixtures for stripping and terminating wires by crimping terminals onto prepared wire ends. Computer control enables rapid and correct wire production and efficient process change-overs.

8 Claims, 8 Drawing Sheets

(56) References Cited

U.S. PATENT DOCUMENTS

| | | | | | |
|---|---|---|---|---|---|
| 5,038,457 | A * | 8/1991 | Yasushi | H01R 43/048 | 29/564.4 |
| 5,127,151 | A * | 7/1992 | Weigert | H01R 43/052 | 29/742 |
| 5,155,907 | A * | 10/1992 | Dornes | H01R 43/28 | 29/749 |
| 5,628,108 | A * | 5/1997 | Ingwersen | H01R 43/01 | 140/1 |
| 5,745,975 | A * | 5/1998 | Heisner | H01R 43/28 | 29/33 M |
| 5,913,469 | A * | 6/1999 | Suzuki | B65H 51/12 | 226/150 |
| 5,943,751 | A * | 8/1999 | Kamei | H01R 43/052 | 29/33 M |
| 9,887,509 | B2 * | 2/2018 | Vladimiro | H01R 43/16 | |
| 2018/0330876 | A1 * | 11/2018 | Yamaguchi | H01F 41/082 | |

* cited by examiner

WIRE INVENTORY INDEXING SYSTEM

PRIORITY: CROSS-REFERENCES TO RELATED APPLICATIONS

This U.S. non-provisional utility patent application is a continuation in part of U.S. non-provisional utility patent application Ser. No. 16/516,672 "Insulation Displacement Termination (IDT) for Applying Multiple Electrical Wire Gauge Sizes Simultaneously or Individually to Electrical Connectors, Stamped and Formed Strip Terminal Products, and Assembly Fixtures Thereof," filed Jul. 19, 2019 and currently pending, which in turn is a continuation-in-part application of U.S. non-provisional application Ser. No. 16/022,496 "Insulation Displacement Termination (IDT) For Mass Termination of Multiple Electrical Wire Gauge Sizes And In Termination Of Multiple Wire Gauge Sizes to Strip Terminal Products," filed Jun. 28, 2018 and now abandoned.

U.S. non-provisional application Ser. No. 16/022,496 claims the benefit of and priority to U.S. provisional patent application 62/532,352 "Insulation Displacement Termination (IDT) Design for Mass Termination of Multiple Electrical Wire Gauge Sizes in IDT Multiple Position Electrical Connector Products," filed Jul. 13, 2017 and now expired.

The parent U.S. non-provisional utility patent application Ser. No. 16/516,672 "Insulation Displacement Termination (IDT) for Applying Multiple Electrical Wire Gauge Sizes Simultaneously or Individually to Electrical Connectors, Stamped and Formed Strip Terminal Products, and Assembly Fixtures Thereof," filed Jul. 19, 2019, and which issues this day, Jan. 28, 2020 as U.S. Pat. No. 10,547,125, and is also a continuation in part of U.S. non-provisional utility patent application Ser. No. 16/133,466 "Discrete Wire Harness Single or Dual Operator Work Center," filed Sep. 17, 2018 and which issued on Aug. 6, 2019 as U.S. Pat. No. 10,374,400.

The U.S. non-provisional application Ser. No. 16/133,466 "Discrete Wire Harness Single or Dual Operator Work Center," of Sep. 17, 2018 also claims the benefit of and priority to U.S. Provisional Application 62/559,934 "Discrete Wire Harness Single/Dual Operator Work Center," filed Sep. 18, 2017 and now expired.

The parent U.S. non-provisional utility patent application Ser. No. 16/516,672 "Insulation Displacement Termination (IDT) for Applying Multiple Electrical Wire Gauge Sizes Simultaneously or Individually to Electrical Connectors, Stamped and Formed Strip Terminal Products, and Assembly Fixtures Thereof," filed Jul. 19, 2019 incorporated the entire contents of U.S. non-provisional utility patent application Ser. No. 16/133,466 "Discrete Wire Harness Single or Dual Operator Work Center," filed Sep. 17, 2018 by reference.

This application incorporates U.S. provisional patent application 62/532,352 "Insulation Displacement Termination (IDT) Design for Mass Termination of Multiple Electrical Wire Gauge Sizes in IDT Multiple Position Electrical Connector Products," filed Jul. 13, 2017 and incorporates U.S. Provisional Application 62/559,934 "Discrete Wire Harness Single/Dual Operator Work Center," filed Sep. 18, 2017 by reference.

This application incorporates U.S. non-provisional application Ser. No. 16/022,496 "Insulation Displacement Termination (IDT) For Mass Termination of Multiple Electrical Wire Gauge Sizes And In Termination Of Multiple Wire Gauge Sizes to Strip Terminal Products," filed Jun. 28, 2018, U.S. non-provisional utility patent application Ser. No. 16/133,466 "Discrete Wire Harness Single or Dual Operator Work Center," filed Sep. 17, 2018, and the parent U.S. non-provisional utility patent application Ser. No. 16/516,672 "Insulation Displacement Termination (IDT) for Applying Multiple Electrical Wire Gauge Sizes Simultaneously or Individually to Electrical Connectors, Stamped and Formed Strip Terminal Products, and Assembly Fixtures Thereof," filed Jul. 19, 2019 by reference.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention generally relates to a wire handling machine used in a wire harness work center for manufacturing wire harness assemblies commonly comprised of multiple wire gauge sizes pulled from bulk storage spools or containers and assembled into completed wire harness configurations optionally including crimped terminals inserted into various cable end insulator housings and also optionally including wire end terminals such as crimped-on lugs.

BACKGROUND OF THE INVENTION

Manufacturers of discrete wire harness assemblies must usually arrange to provide an extensive inventory of components that require high labor content to assemble in order to produce acceptable finished products to their OEM customers. Labor-intensive tasks commonly include selecting and handling correct wires types and sizes, and selecting from a myriad of loose piece components such as connector housings, hardware, clips, terminals, all of from among large numbers of bulk supplies. Other tasks include pulling wire and routing groups of wires around pegs and other such layout fixtures to establish proper lengths for each wire of a product being manufactured, inserting wires into terminal and jacket crimping and forming machines, and snapping or inserting terminated wires into proper cavities of cable end connector housings, or arranging groups of wires cables onto insulation-displacement devices and mass-terminating these groups using an arbor press or some other high-force machine.

Thus cable assembly work entails much dexterity, attention to details, fine finger work, the ability to follow complex assembly and testing instructions, and to react correctly as these instructions are changed to follow various and flexible production schedules. Wire harness manufacturing entails an intense amount of complex and detailed work, all of which must be executed competently and correctly.

Thus opportunities exist and will continue to exist for reducing labor costs by simplifying tasks, providing machines that can execute sets of similar functions simultaneously, and machinery of fixtures which are easy to re-configure so that flexible manufacturing work cells may convert from one setup to the next with less time, less effort, and while minimizing the opportunity for manufacturing errors.

BRIEF SUMMARY OF THE INVENTION

From the aforementioned background it is understood that many objectives exist. A primary objective of the invention is to arrange and provide a configurable fixture for use within a work station to assist with pulling wires, cutting them to required lengths, and preparing wire ends such as by stripping off insulation jackets or by crimping terminals to wire ends.

Since the largest portion of the expense in producing a wire harness assembly is in the management of so many different wires and leads, another objective of the invention is to reduce a unit cost of the harness produced in the work station by enabling mass terminations or in-gang assemblies of similar or sufficiently identical components so that a single action of an application-specific machine or tool may correctly and completely execute a plurality of similar or identical assembly steps in several closely collected locations. Thus another objective of the invention is to enable pulling and cutting to length of appropriate wires in sets of two or more wires at a time.

Another objective of the invention is to reduce "in-process inventory movement," which includes the time expended to correctly select and pull wires from mixed bulk supplies that may then be cut to their proper lengths efficiently. Reductions of "in-process inventory" for wires or other components in motion directly reduce the unit cost of a finished wire assembly, because then burden rate or overhead costs of operating an assembly work cell also include the required labor to maintain the facilities and the handling of in-process inventories.

Combined with a capability to perform more than one identical tasks in a single space, it is therefore an additional objective of the invention to arrange all assembly and process infrastructures in a smaller space and volume than current methodologies typically require and consume.

From the foregoing, there is also seen a need for streamlining the process for changing over a set-up for making one assembly to a configuration for making a different assembly. Universal, programmable tooling may then effect substantial cost savings over current manufacturing operations. Various devices are currently available which attempt to address these challenges, although they may at best meet only one or two aspects of the totality of the requirements.

BRIEF DESCRIPTION OF THE DRAWINGS

A further understanding of the nature and advantages of particular embodiments may be realized by reference to the remaining portions of the specification and the drawings. Similar reference numerals are used to refer to similar components.

DETAILED DESCRIPTION OF THE INVENTION

Figure 1:
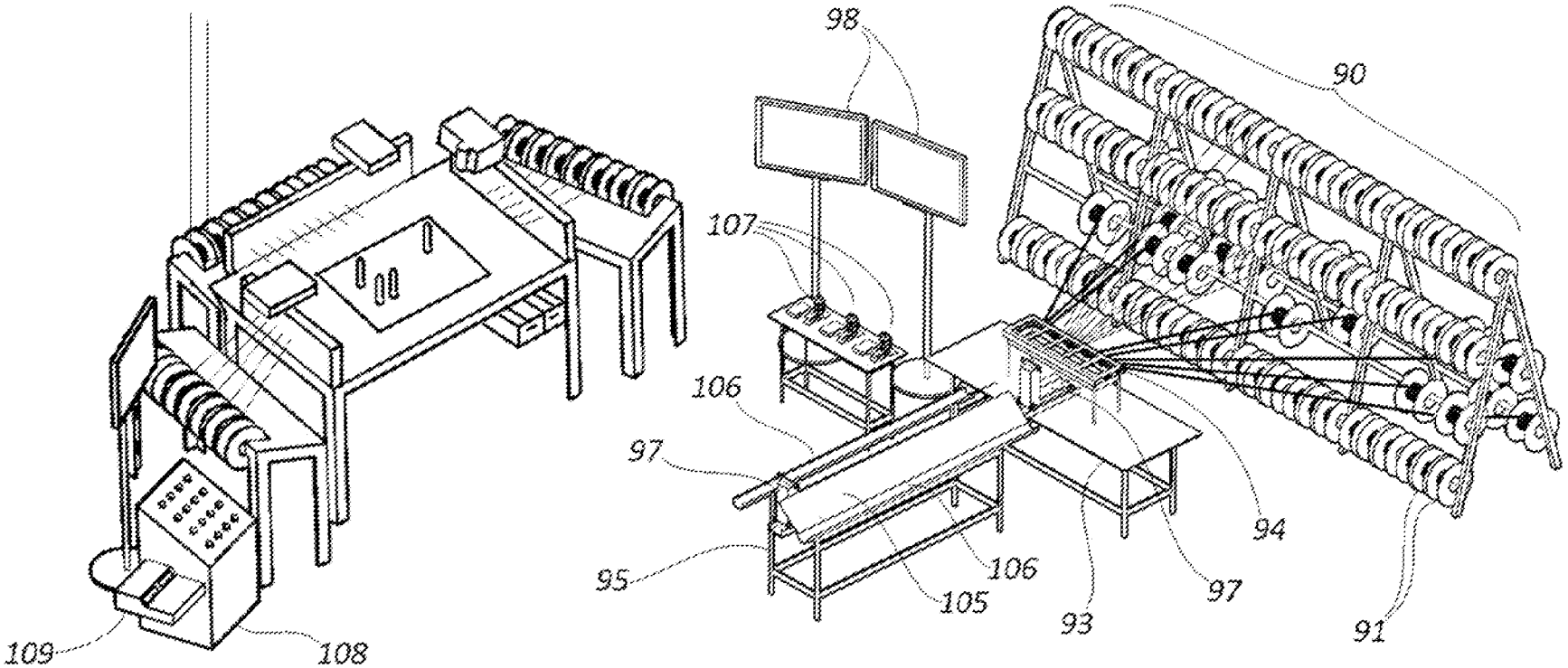
FIG. 1 shows a work cell in accordance with a parent application, which includes a computerized discrete wire inventory indexing system in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this specification, the term "means for . . . " as used herein including the claims, is to be interpreted according to 35 USC 112 paragraph 6.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered nonexclusive. Also, terms such as "element" or "component" encompass both elements and components comprising one unit and elements and components that comprise more than one unit, unless specifically stated otherwise.

In this specification the word "substantially" when used as a comparative, such as a first quantity, parameter, or geometric entity being "substantially equal to" or "substantially parallel to" or "substantially perpendicular to" a second quantity, parameter, or geometric entity shall be taken to mean that for numerical values the second value resides within 10% of the first value and for angular measures the second entity resides within 10 of the condition referencing the first entity.

Also in this specification the word "wire" may be used interchangeably with the word "cable" when meaning a single strand structure comprising a solid or a stranded central conductor surrounded by an insulating coating or a jacket. A "wire" in this specification may have a solid central conductor or a braided or served strand built up from a plurality of solid conductors. Some wires have a built-up core of multiple conductors, with each individually coated a solder or a brazing material which is heated to bond the group to act as a unitary conductor. Also in this specification, where the word "terminal" or its plural is used without any other adjacent word defining or limiting the scope or type of terminal, then the word applies to all types of terminals and all manners of bulk supplies of these terminals, such as side feed, end feed, and loose piece terminals. As the wires are drawn and cut to length by the invention material moves from bulk stores, through guiding devices such as fairleads and infeed guides, through clamps, outfeed guides, and wire cutters. The direction of material motion over time allows the use of relative words used to describe sequences in time such as "before" and "after" and words describing relative positions in a flow such as "ahead of," "upstream," and "downstream" to be used to describe the relative positions or sequences of components within a series of elements spaced out along a length of wire set up and threaded through the inventive machine.

During cable and wire harness assembly, fixtures are often used for assembling wire harnesses for nearly any industry, the devices and their arrangements as disclosed in this document may offer some of their greatest benefits and improvements to wire harness assembly in the automotive industry. Wire and lead production may proceed at a rate of more than 3,000 wires or leads per hour, and may include tasks such as handling wires of different gauges, different lengths, different colors, or having different terminals crimped to them, and other variations in accordance with customer requirements. A significant amount time is consumed in handling wires from the time they are produced to the time they are assembled on the harness boards and finally packaged and shipped. The time defined by movement of one cut wire length from one place to another is referred to as "in-process inventory movement" of wires or leads. Inventory retained for a long period of time has an inherent cost where return on investment is affected. By reducing in-process inventory time in the manufacturing cycle, the end cost of a completed wire assembly may also be effectively reduced, when compared to a conventional production arrangement as described in the incorporated patent application Ser. No. 16/133,466 for FIGS. 1 and 4*a*.

Now referring to the figures, FIG. 1 shows a work cell in accordance with a parent application, which includes a computerized discrete wire inventory indexing system in accordance with the invention. The work station shown includes termination tools or machines for terminals supplied in bulk such as side feed, end feed, and tape mounted terminals. The work cell is a configurable modular work space where assembly tools, jigs and fixtures, and machinery may be arranged for production and verification testing of various wire harness assemblies, wherein the modules and work spaces within the work cell may be rapidly, easily, and safely rearranged for most efficient production of a product to OEM or customer specifications.

Discrete wire termination stations [107] may be configured to process many types of wire terminals, including but not limited to end feed terminals, side feed terminals, loose terminals, and tape mounted terminals. Cost saving benefits include that the use of universal applicator tooling may eliminate a need to purchase or lease dedicated application tooling, and manufacturing time savings during setup or to transition from one terminal strip to another.

Although bulk quantities of wire are available in spools, tubs, boxes, or barrels, in this illustration wires are shown in spools [91] arranged on a hulk supply frame [90.] Bulk wire supplied by barrel may contain up to 17 miles of wire per barrel. Wires of various types and sizes are pulled from bulk supplies and routed to a programmable discrete wire inventory indexing system [94] which registers in a movable carriage all wires called for in a product to be built. The movable carriage is called a wire feeder in this specification. The wires may be retained by insertion into gaps of an extended helical spring as is explained and illustrated below. The wires are registered into a linear array on the wire feeder.

Computers and video display monitors [98] are positioned at work areas and component storage areas and in view of workers at activity stations within the work cell. Display monitors may indicate inventory on hand and may be part of a kanban system for more automated inventory replenishment or a heijunka system for scheduling "pitches" of work intervals comprising mixed product production.

A movable shuttle [97] travels along an axis by residing in a longitudinal channel or traveling along one or more longitudinal rails. A clamp or gripper on the movable shuttle grabs a desired wire which is presented to it by the lateral motion of a wire feeder of the wire inventory indexing system typically mounted to a work bench [93.] In this illustration the shuttle is depicted at two such locations, but in practice there is only one shuttle traversing a given rail system. Cost saving benefits include a capability for multiple wire types to be inventoried at the assembly site, which reduces in-process inventory time, and time used for wire selection and lead preparation. Cost savings may be doubled when the shuttle pulls pairs of wires destined for two adjacent work cells, or in the quadruple setup described in FIG. 2*b*, where two shuttles operating simultaneously may together pull and cut to length four identical sets of wires to be used in a cluster of four adjacent work cells.

Once each clamp on the shuttle has grasped an appropriate wire, on command from a production control computer the shuttle travels away from the inventory retainer to a programmed, predetermined distance which defines the length of the wires as they are cut from the wire inventory indexing system, which includes wire cutting and if necessary wire stripping fixtures or tooling. The production control computer may be a general purpose computer programmed to command the production activities such as but not limited to: moving the wire feeder into a position so that it presents one or a pair of wires to wire grippers on the shuttle, moving the wire shuttle on its track a desired distance to establish a desired wire length from an end of the wire held in a wire gripper to a wire cutter on the frame, commanding the cutting of wire and pinching and releasing of wire pincers on the shuttle, and commanding the tensioning and release of wire clamps. Furthermore, the inventive wire inventory indexing machine may also include fault sensors at wire guides, wire cutters, and grippers, and may include other sensors which indicate that a spool or bulk store of wire has run out or is nearly exhausted, or that a cutting operation did not complete successfully, or that the motion of the shuttle is obstructed by a foreign object, or other such events. The production control computer is preferably configured to emit warning or fault messages and to compile audit logs these events and other operations, and may also compile aggregate production logs including internal time and motion studies and statistical analyses of production runs or pitches such as Cpk figures for actual lengths of wire drawn as compared to acceptable tolerances. Production data as compiled is valuable for quality control audits and process improvement studies. The production control computer may also be programmed to offer semi-automatic operations, single cycle and stop functions, or manual step by step and individual command and control of wire cutting, wire feed position, the motion of the wire shuttle, and the gripping and releasing of individual wire grippers and clamps. Event logging may be continued even during manual or semi-automatic operations to assess the competence and speed of individual operators or work cell teams so as to identify training needs and other corrective actions.

Intermediate cuts of the jacket alone, called center strip cuts, may also be executed at the carriage of the programmable wire inventory machine. A slight drag is maintained on the wire jacket for a short period of time after the jacket is cut so that its travel is retarded as the central conductors are exposed. Once cut to length, the loose wires then fall along the sloped surfaces [105] of the presentation table [95] and collect in a trough [106] affixed to the lower edge of the sloped surfaces. For a wire presentation table having two staging troughs, one for each work cell, the shuttle has a pair of clamps so that the desired wires for each stage of selection and cutting to length may be picked up in pairs; one for each work cell. Thus instead of cutting wires to length elsewhere and transporting cut lengths by means in which they become unsorted in transit (such as by bucket) each wire is cut to length in situ, which may reduce the opportunity for assembly errors such as mis-wiring.

The wire inventory indexing system is controlled by a central computer for serving and accumulating production data and for sequencing the manufacturing steps of the wire harness product to be built and may be housed within a console [108] having a control panel. The control panel includes annunciators, display lamps, and controls such as buttons or switches which may also be illuminated. The controls at this console may also operate other machinery shown in this work cell.

Also attached to the console is a sequencing controller [109] which incorporates the keyboard used for alphanumeric input to the central computer. This controller also allows manual overrides for any automated process controlled by the central computer.

Figure 2A:
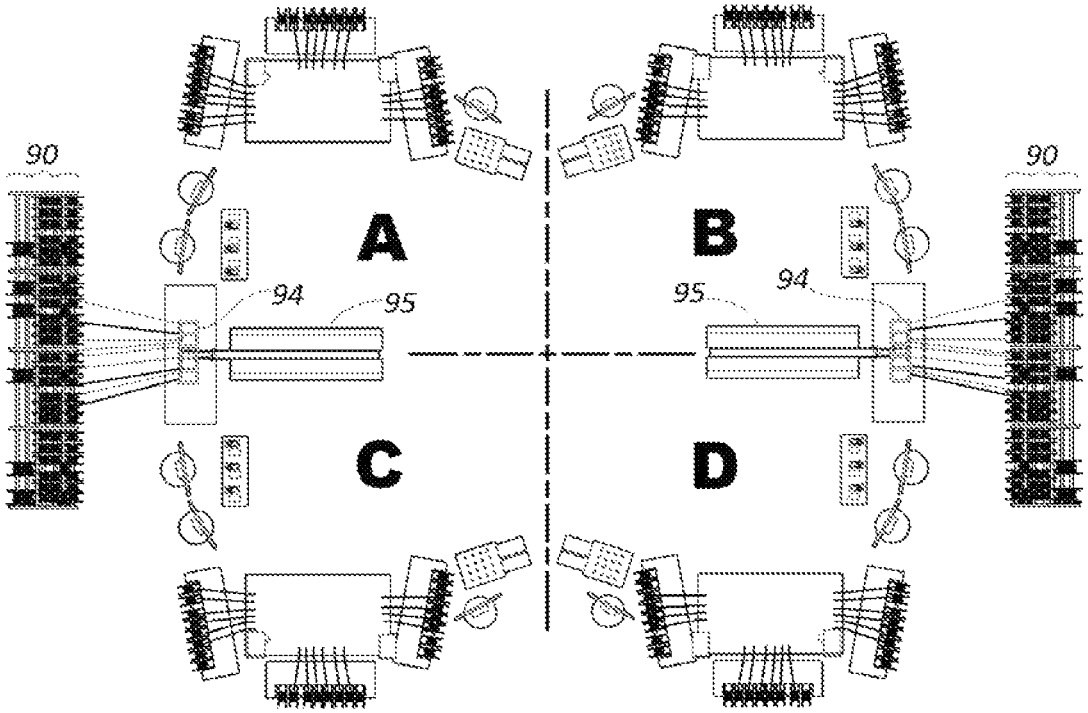
FIG. 2*a* shows a top view of four symmetrical work cells with two of the wire inventory indexing systems in accordance with the invention operating at boundaries between adjacent work cells, and having bulk stores of wire located beneath the indexing system and beneath the presentation tables of the work cell.

FIG. 2*a* shows a top view of four symmetrical work cells with two of the wire inventory indexing systems [94] in accordance with the invention operating at boundaries between adjacent work cells, and having bulk stores of wire located in proximity to the indexing system and beneath the presentation tables of the work cell. Each wire inventory indexing system pulls and cuts wires to length for presentation tables [95] designed to service two adjacent work cells.

Figure 2B:
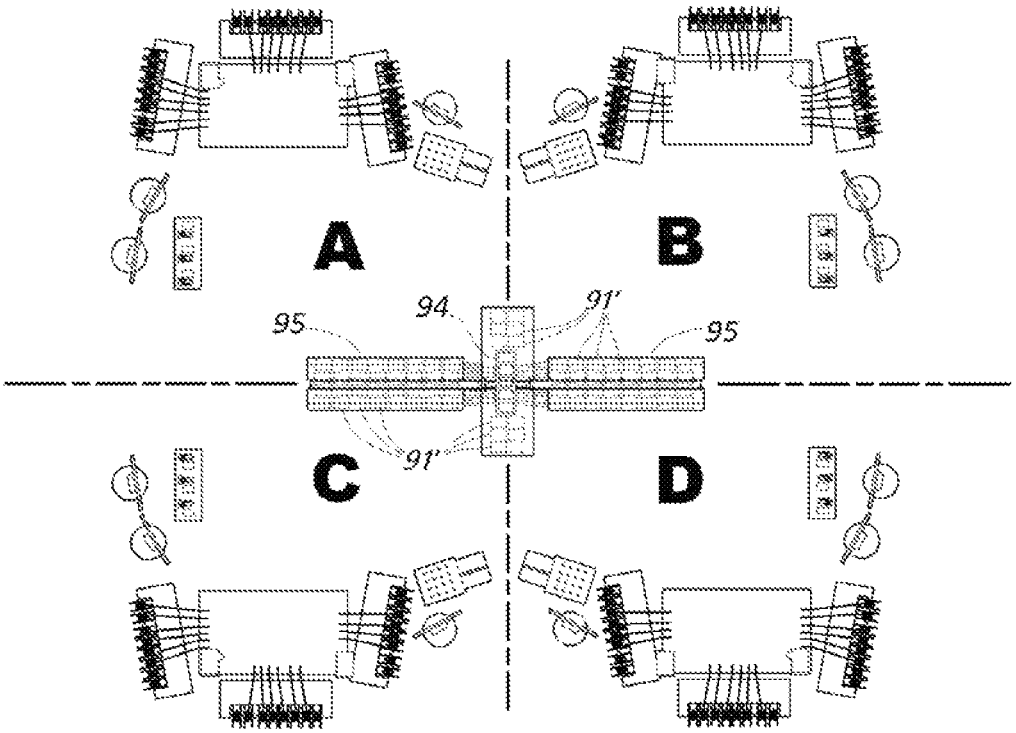
FIG. 2*b* shows a top view of another arrangement of four symmetrical work cells, with a single, central wire inventory indexing system in accordance with the invention operating in the center of the four work cells.

FIG. 2*b* shows a top view of another arrangement of four symmetrical work cells, with a single, central wire inventory indexing system in accordance with the invention operating in the center of the four work cells. The wire inventory indexing system [94] receives wires from stores which may be located within the frame below the movable wire feeder, and additional storage space may be available beneath the adjacent presentation tables [95.] Bulk wire is pulled from rectangular cartons [91'.] Bulk wire may also be staged in a loft above the wire inventory indexing system and fed vertically downward to the machines.

Figure 3:
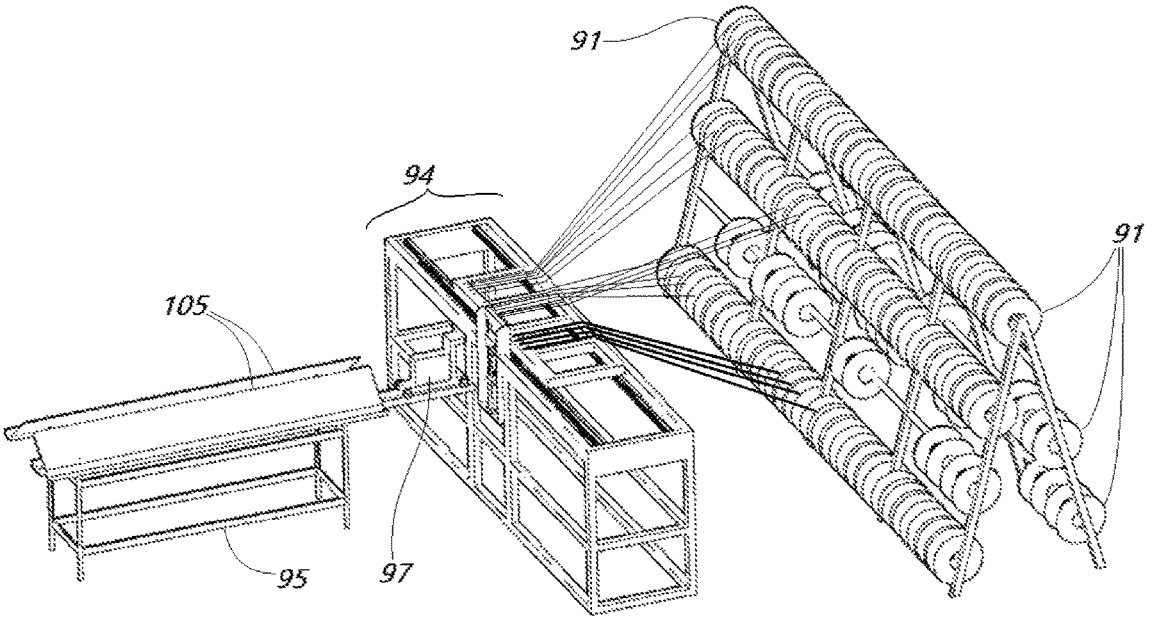
FIG. 3 shows an embodiment of a wire inventory indexing system in accordance with the invention operating between a bulk supply rack holding assorted spools of wire and a presentation table for delivering cut-to-length wires to two adjacent work cells.

FIG. 3 shows an embodiment of a wire inventory indexing system [94] in accordance with the invention operating between a bulk supply rack holding assorted spools of wire [91] and a presentation table [105] for delivering cut-to-length wires to two adjacent work cells. The wire puller is a movable shuttle [97] that travels along an axis by residing in a longitudinal channel or traveling along one or more longitudinal guides such as rails, rods, or bars. A clamp on the movable shuttle grabs a desired wire which is presented to it by the lateral motion of a wire feeder of the wire inventory indexing system. Once cut to length, pairs of loose wires then fall along the sloped surfaces [105] of the presentation table [95] and collect in a trough affixed to the lower edge of the sloped surfaces. A wire feeder is a movable plate or frame which translates in a shift direction which is perpendicular with respect to a feedthrough direction defined by a collinear arrangement of a wire infeed guide, a clamp infeed guide, an automatically controlled wire clamp, and a wire outfeed guide set up for every type of wire to be made available for assembly in the work cell.

Figure 4A:
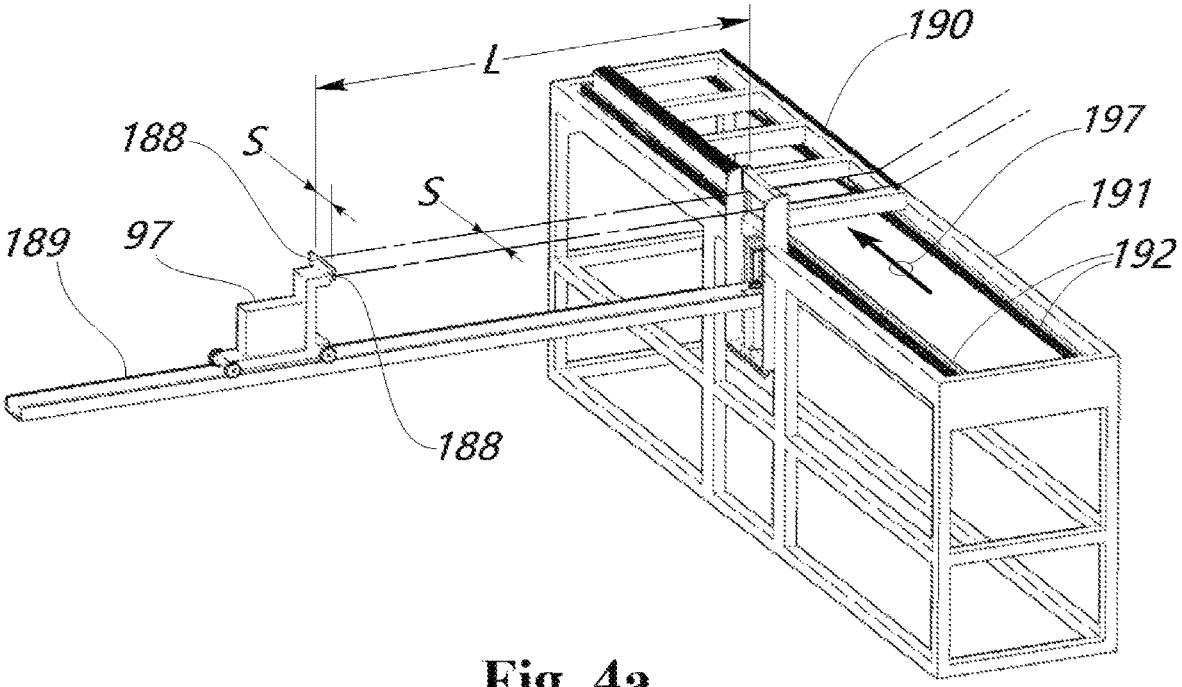
FIG. 4*a* shows the wire inventory indexing system of FIG. 3 with its wire feeder displaced along a shift direction, and with some parts of the presentation table omitted to reveal the wire shuttle and the guide or track which the wire shuttle traverses.

FIG. 4*a* shows the wire inventory indexing system of FIG. 3 with its wire feeder [190] displaced with respect to the frame [191] along a shift direction represented by arrow [197,] and with some parts of the presentation table omitted to reveal the wire shuttle [97] and the guide or track [189] which the wire shuttle traverses. The wire feeder is slideably coupled to the frame and may be driven by an endless silent chain, or preferably by a drive system including a threaded rod, such as a programmable ball screw precision movement. The production control computer or a local encoding device may be employed to count the number of turns of a threaded drive rod, of a motor shaft, or of a rotatable female threaded feature used for translating the shuttle along a stationary threaded member.

The wire shuttle includes two clamps or pincers [188] which reach past a wire cutting mechanism on the frame and grab a pair of wires spaced apart on the moveable wire feeder by a dimension 'S.' The locations within the pincers where the two wires are grabbed and the separation distance of the wires as they are pulled from the wire feeder are also substantially equal to the spacing dimension 'S.' The wire feeder has a linear array of wire infeed guides spaced apart along the shift direction, a linear array of wire outfeed guides spaced apart along the shift direction, and a linear array of wire clamps spaced along the shift direction. Lateral translation of the wire feeder is accomplished by linear actuators [192] which may comprise one or more threaded rods driving non-rotating nuts or complementary female threaded features built into the frame, or may be pneumatic actuators or one or more endless cable, belt, or drive chain loops driven by a motor-driven sheave or sprocket affixed to the frame. Phantom lines extending rightward from the frame denote the pair of supply wires fed in from bulk supplies such as cartons or a frame of wire spools such as item [90 in FIG. 1.] A position encoder may be incorporated within a linear actuator, or may also be employed to count a number of turns of a threaded drive rod for arithmetically deriving a position or location of the wire feeder on its frame.

Figure 4B:
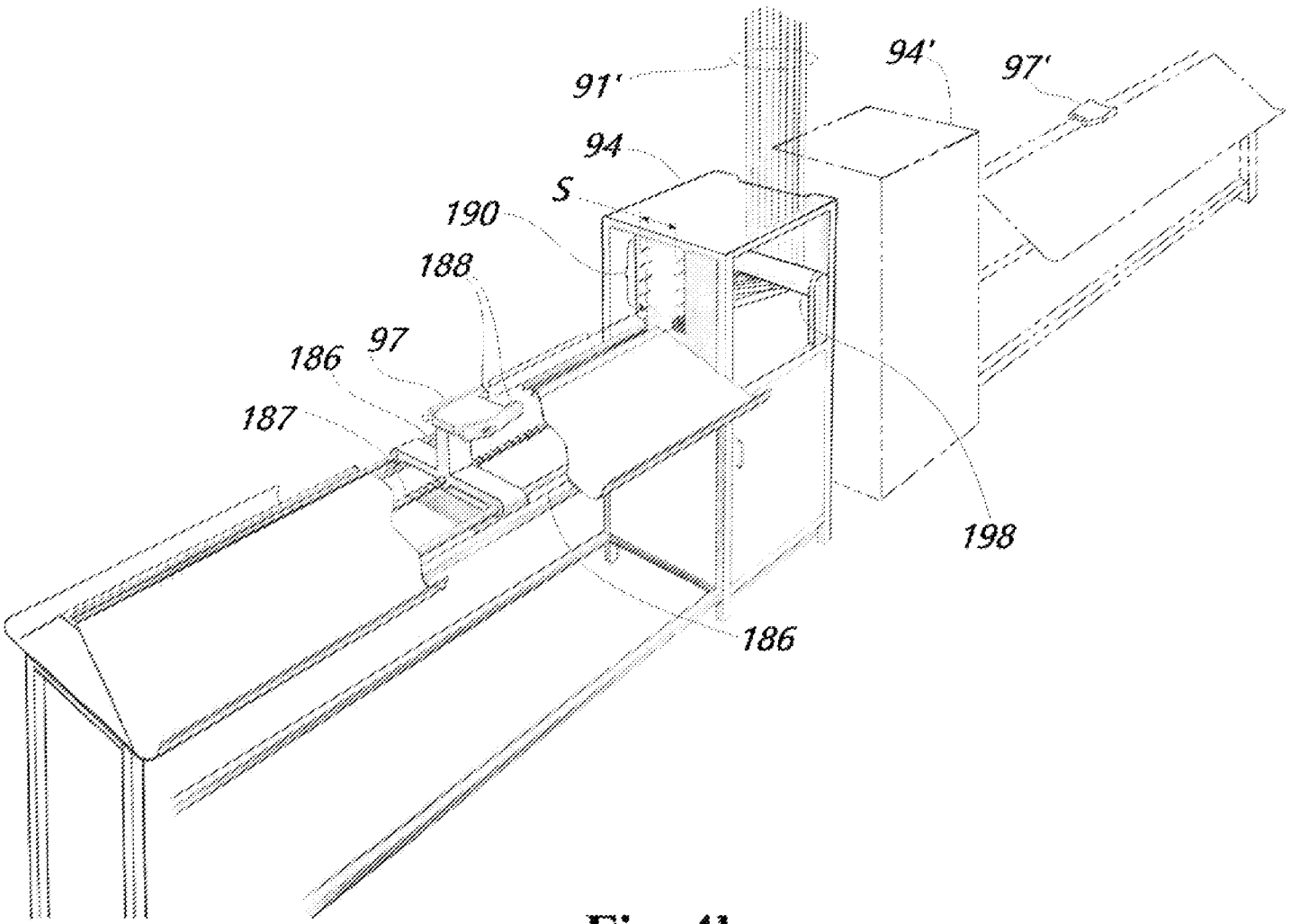
FIG. 4*b* shows an alternative embodiment of a programmable discrete wire inventory indexing system in which the wire feeder, while translatable in a shift direction, moves vertically with respect to the feedthrough direction of the wires presented to the wire shuttle.

FIG. 4*b* shows an alternative embodiment of a programmable discrete wire inventory indexing system [94] in which the wire feeder [190,] while translatable in a shift direction, moves vertically with respect to the feedthrough direction of the wires presented to the wire shuttle [97.] The vertically translatable wire feeder presents pairs of wires of identical types with each pair separated by a distance "S." Wires of various types are supplied to the machine as vertically oriented strands leading from bulk stores suspended above the machine, or from a supply loft, or an inventory space built on a floor above the production floor where the work cells are located. The wires then follow around a fairlead [198] which directs the wires to their individual infeed guides, clamps, and outfeed guides on the wire feeder. The infeed guides and outfeed guides are aligned in a feedthrough direction perpendicular to the vertical shift direction of the wire feeder.

The wire shuttle translates by means of a precision ball screw drive which includes at least one guide [186] and a treaded rod [187.] The shuttle includes two clamps or pincers [188] which are also separated by a distance "S." For the symmetrical four-cell arrangement described for FIG. 2*b*, a second wire inventory indexing system [94'] with its table and shuttle [97'] may be positioned back to back as shown in phantom line.

Figure 5A:
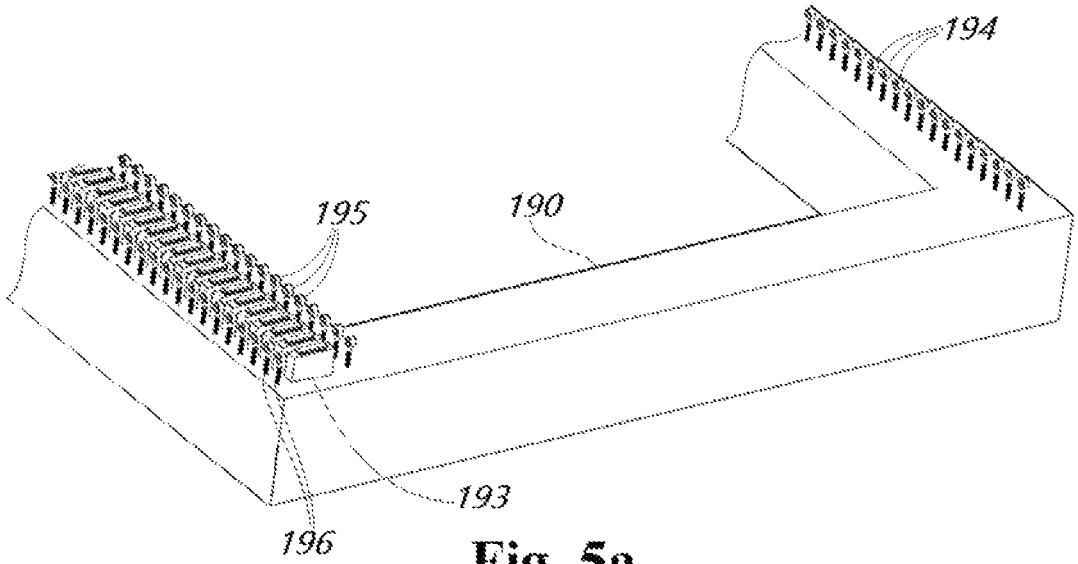
FIG. 5*a* shows a portion of a wire feeder in accordance with the invention, having wire infeed guides and outfeed guides, and automated wire clamps.

FIG. 5*a* shows a portion of a wire feeder [190] in accordance with the invention, having wire infeed guides and outfeed guides [196,] and automated wire clamps [193.]A feedthrough direction is defined by the series of parallel wires handled by the wire feeder as each wire passed through the infeed and outfeed guides. Even though an incoming wire is already fed through first in-feed guide [194,] the first in-feed guide primarily acts as a fairlead for reducing any skew angles from drawing wire from bulk stores not necessarily in line with the frame. Since the wire feeder frame moves laterally with respect to the feedthrough direction as it presents different sets of wires to the shuttle, an incoming wire may be nearly parallel to the feedthrough direction while the wire feeder is presenting one pair of wires, but be substantially out of parallel when the frame shifts laterally to present other wires for drawing to length and cutting. Thus each wire position also includes a second infeed guide [195] also incorporated in the wire feeder which the wire encounters just before the clamp. Having two feed guides in close proximity before and after the clamp allows the clamp to operate on the wire more effectively. Infeed and outfeed guides may comprise eyelets, wickets, loops, hoops, or they may be formed as a gap between two lateral limits or control features such as a slot with its walls on both sides of a wire received therein, or a gap between two raised fins or vanes for a wire received therein.

Figure 5B:
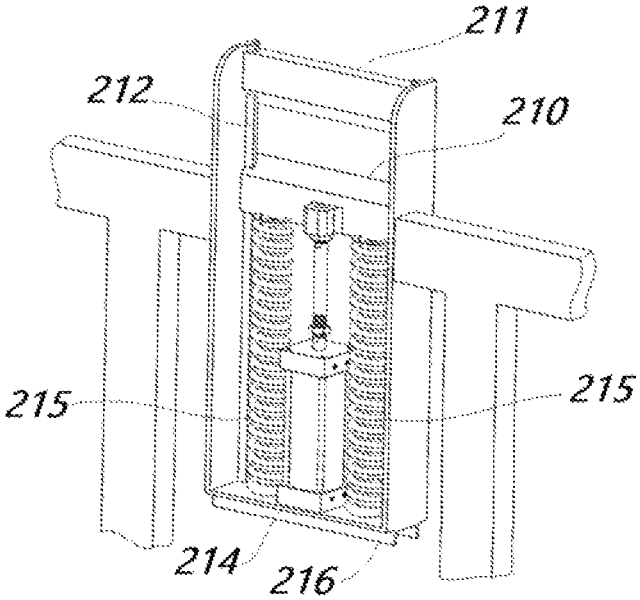
FIG. 5*b* shows some components of a tandem wire cutter for a wire inventory indexing system in accordance with the invention.

FIG. 5*b* shows some components of a tandem wire cutter for a wire inventory indexing system in accordance with the invention. The cutting device includes a stationary anvil [211] and a movable knife [210] which closes against the anvil when forced to do so by an air cylinder [214.] Other pneumatic, hydraulic, or solenoid cutters may be used within the scope of the invention. A channel [216] or other structural beam provides section modulus beneath the frame of the cutter to resist bending while opposing the cutting force brought against wires pinched between the knife and anvil. The knife rises and falls by moving along guides [212] and is returned to an open position after cutting by return springs [215.] The wire grippers on the wire pulling shuttle are designed to reach into the open jaws of the wire cutter to pull wires or pairs of wires presented to them by the wire feeder. Wire length is controlled by the production control computer stopping the shuttle once the distance from the end of a wire gripped in a wire gripper of the shuttle to the knife edge of the cutter equals the desired wire length to be produced.

Figure 6:
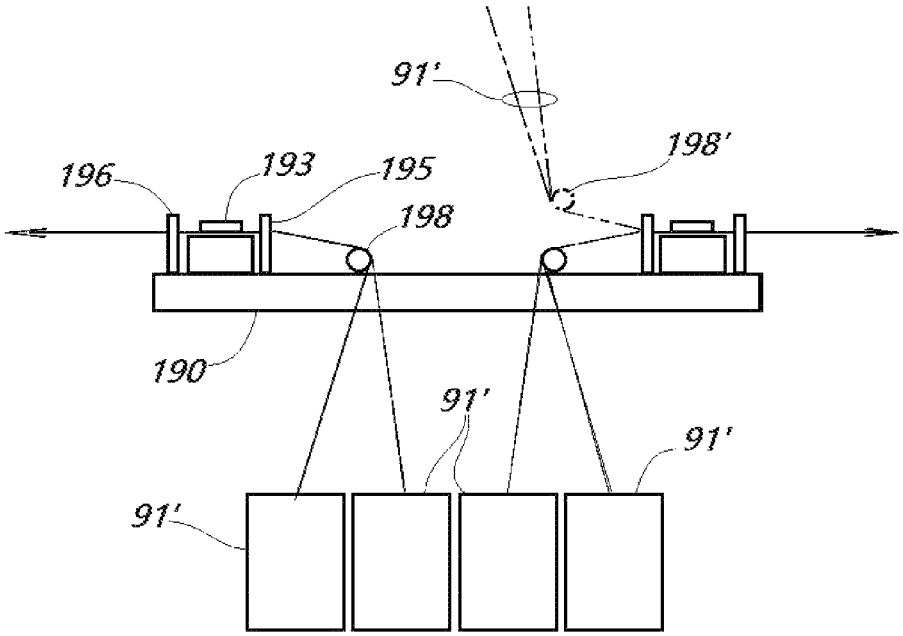
FIG. 6 shows a stylized representation of an end view of a wire feeder in accordance with the invention configured to pay out paired sets of wire in two different directions, and having bulk stores of wire located above or beneath the indexing system.

FIG. 6 shows a stylized representation of an end view of an alternative embodiment of a wire feeder [190] in accordance with the invention configured to pay out paired sets of wire in two parallel but opposed feedthrough directions, and having bulk stores of wire [91'] located beneath the indexing system. A fairlead [198] directs wires from bulk stores to individual infeed clamps [195] where each wire then passes through a computer-controlled clamp [193] and then through an outfeed guide [196.] After being cut to length, lengths of wire remain cantilevered past the outfeed guide and are accessible to wire grippers on the movable shuttle [97 of FIG. 3.] The wire feeder of this figure is adaptable to feed out pairs of wires in opposite directions such as for the central wire inventory and dispensing system shown in the middle of the four work cells seen in FIG. 2*b*. Besides cartons or spool storage below the wire feeder, bulk stores of wires may be positioned in a loft or storage facility above the work center, as shown by the wires drawn in phantom line and passing through an alternate fairlead [198'.]

Figure 7:
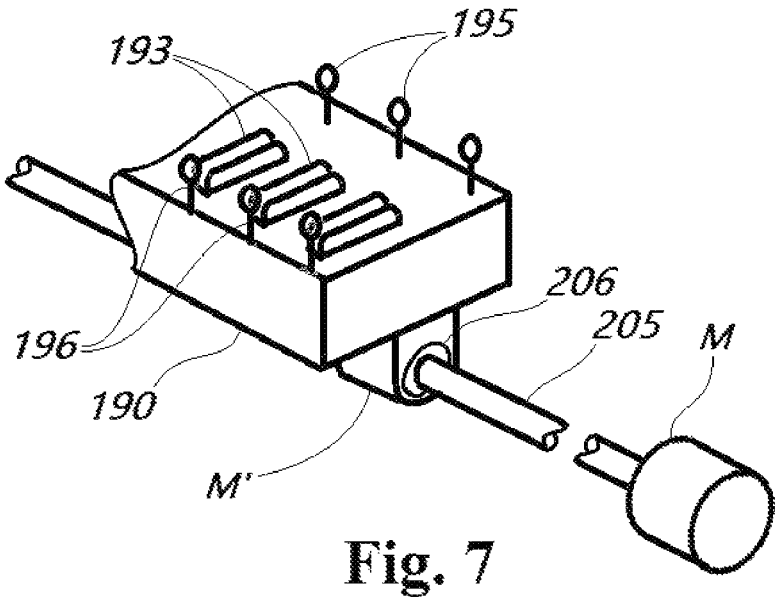
FIG. 7 shows a portion of a wire feeder of the invention further comprising a component having internal threads, optional locations for a motor for driving the wire feeder along a shift direction, and a portion of a linear actuator operably coupled between the wire feeder and the frame of the invention.

FIG. 7 shows a portion of a wire feeder [190] of the invention further comprising a component having internal threads, optional locations for a motor [M] for driving the wire feeder along a shift direction, and a portion of a linear actuator operably coupled between the wire feeder and the frame of the invention. In this embodiment the wire feeder comprises one or more threaded rods [205] driving non-rotating nuts or complementary female threaded features [206] built into the frame. Alternatively, the threaded rod may be stationary and a drive motor [M'] installed on the moveable wire feeder may rotate the female threaded component so that the wire feeder moves along the length of the stationary rod. This view also shows a portion of the wire feed incorporating infeed clamps [195,] where each wire passes through a computer-controlled clamp [193] and then through an outfeed guide [196.] The wires themselves are not shown. A position encoder may also be employed to count a number of turns of a threaded drive rod, of a motor shaft, or of a rotatable female threaded feature used for translating the wire feeder along a stationary threaded member.

Figure 8:
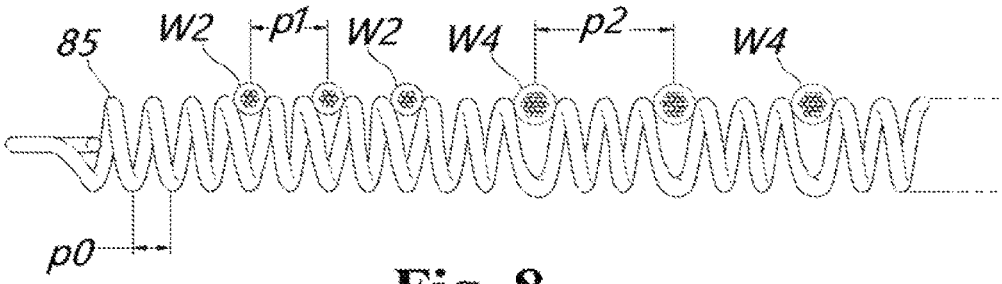
FIG. 8 shows a helical spring used to retain wires at various pitches between its coils for a wire feeder in accordance with the invention.

FIG. 8 shows a helical spring [85] used to retain wires at various pitches between its coils for a wire feeder in accordance with the invention. The gentle lateral pinching of the spring coils on the sides of the wire may be utilized on the wire feeder frame to assist with positioning the wires as they leave the clamps or after they pass through the outfeed guide. The spring is secured at it ends and extended along the wire feeder so that the helix spreads to a substantially uniform pitch [p0.] As an assistance for placing wires of various sizes in position presentation to the wire shuttle, the extension of the spring may be set so that for wires of multiple pitches [p1] and [p2] etc, the pitch of the helix is set to at or near the largest common denominator of the pitches in the wire spacings. For example, if signal wiring of a size [W2] is spaced at 0.060 in apart [p1] and power wiring of a size [W4] is spaced at 0.090 in apart [p2,] then the spring may be stretched so that the coil pitch and its openings between the coil reside on a pitch [p0] of 0.030 in apart.

Figure 9:
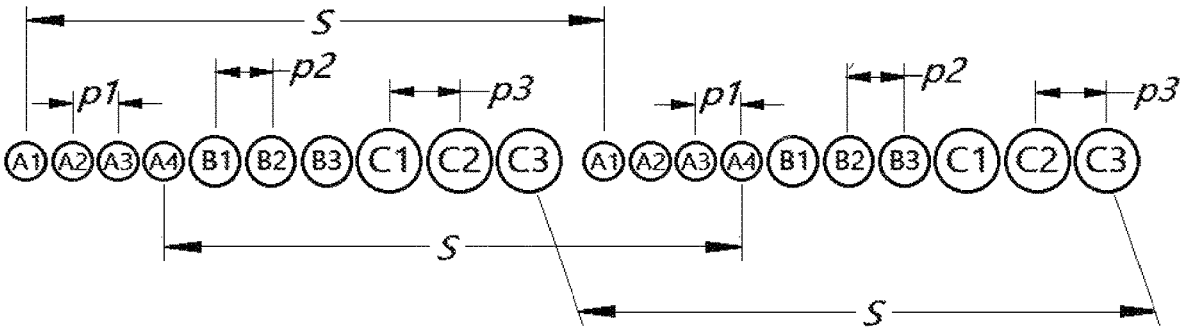
FIG. 9 shows duplicated series of wires of various types, sizes and colors, arrayed so that each wire is identical in type and color to another wire spaced apart from it by a separation distance "S."

FIG. 9 shows duplicated series of wires of various types, sizes and colors, as arrayed in the wire feeder so that each wire is identical in type and color to another wire spaced apart from it by a separation distance "S." Small wires [A1,] [A2,] [A3,] and [A4] may be placed on a pitch [p1.] Wires larger than these [B1,] [B2,] and [B3] may then be placed on a pitch [p2.] A series of larger wires [C1,] [C2,] and [C3] may then be placed on a pitch [p3.] For any given type and color of wire arrayed as explained herein, one other wire of the exact type and color will reside at a distance "S" from that given wire. In other words the wire feeder includes first and second outfeed guides within a linear array of wire infeed guides, and third and fourth outfeed guides also within the linear array of wire infeed guides, such that if the second infeed guide is disposed at a distance 'S' from the first infeed guide along the shift direction of the wire feeder, then the third infeed guide will also disposed at the same distance 'S' from the fourth infeed guide along the shift direction of the movable wire feeder.

Therefore with this wire arrangement it is always possible to shift the wire feeder so as to present two identical wires to the wire grabbers of the wire pulling shuttle if the wire grabbers are also spaced apart at a distance "S." By this mechanism, the wire pulling shuttle is able to pull pairs of identical wires, and then the wire cutter cuts the pair of wires simultaneously. As a specific example, if a the two pincers are left and right pincers spaced apart a distance "S" on the shuttle, and the left pincer is aligned to grab the left wire A4 in this figure, then the right pincer will be aligned to grab the right wire A4, which is a wire of the same size and jacket color. If the wire feeder then shifts leftwards in this view so that the left pincer is aligned to grab the left wire C3 in this figure, then the right pincer will also be aligned to grab the right wire C3, so that the pincers will always be pulling identical pairs of wire to length.

Figure 10:
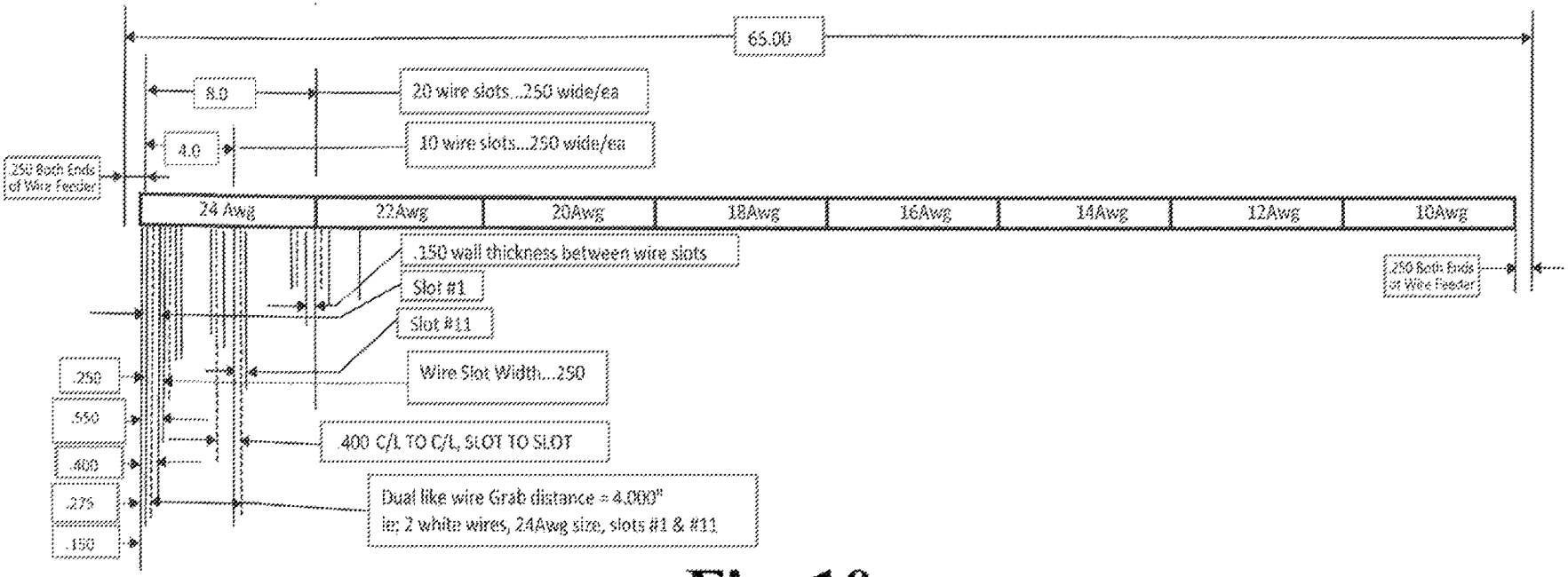
FIG. 10 shows a dimensional arrangement for wire-receiving slots in a wire feeder in accordance with the invention.

FIG. 10 shows a dimensional arrangement for wire-receiving slots in a wire feeder in accordance with the invention. In this specific example wire outfeeds are slots of 0.250 inch width each with 0.150 inch separating walls between the slots. The "S" dimension for this system is 4.0 inches and the entire plurality of wire sizes from 24 AWG (American Wire Gauge) to 10 AWG are arranged in subsets of particular gauge sizes. Within each block of wire gauges reside up top 11 pairs of slots separated by a distance "S" which is 4 inches in this schema. Wires within each gauge size block may be sorted by jacket color or by different numbers of strands for the same wire size, so that selections may be made based on wire flexibility, conductor resistance, current capacity, temperature endurance, or high-speed signal characteristics. Each block of wire gauges may extend up to a maximum width of 2 times "S," or 8 inches in this example. The wire feeder is 65 inches wide and sorts and supports up to 88 different types and sizes of wires.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise.

Consequently and in summary, although many exemplary embodiments are described above, it will be appreciated that the invention is intended to cover all modifications and equivalents within the scope of the following claims.

What is claimed is:

1. A wire presentation apparatus, comprising
- a frame having at least one guide extending along a shift direction,
- a wire feeder slidably coupled to said guide, said wire feeder further comprising
  - a linear array of wire infeed guides spaced apart along said shift direction,
  - a linear array of wire outfeed guides spaced apart along said shift direction, and
  - a linear array of wire clamps spaced along said shift direction, and
- a linear actuator operably coupled between said frame and said wire feeder, and
- a shuttle moveable along a feedthrough direction defined by a series of wires handled by said wire feeder, said shuttle further comprising at least one wire clamp.

2. The wire presentation apparatus of claim 1, further comprising a position encoder for said wire feeder.

3. The wire presentation apparatus of claim 1, wherein said linear actuator further comprises a threaded shaft.

4. The wire presentation apparatus of claim 1, wherein said linear actuator is a ball screw movement.

5. The wire presentation apparatus of claim 1, further comprising a production control computer.

6. The wire presentation apparatus of claim 1, wherein said wire clamp, said infeed guide, and said outfeed guide are collinear.

7. The wire presentation apparatus of claim 1, wherein said wire feeder further comprises first and second outfeed guides within said linear array of wire infeed guides, and
- third and fourth outfeed guides within said linear array of wire infeed guides, such that
- with said second infeed guide disposed at a distance "S" from said first infeed guide along said shift direction,
- said third infeed guide is also disposed at said distance "S" from said fourth infeed guide along said shift direction.

8. The wire presentation apparatus of claim 7, further comprising a shuttle having two wire grippers spaced apart at said distance "S.".

* * * * *